US009708550B2

(12) United States Patent
Augier et al.

(10) Patent No.: US 9,708,550 B2
(45) Date of Patent: Jul. 18, 2017

(54) EXTRACTION OF SULPHUR-CONTAINING COMPOUNDS IN A FIRST PRETREATMENT REACTOR OPERATING IN BATCH MODE FOLLOWED BY A SECOND PRETREATMENT REACTOR OF THE PISTON TYPE

(71) Applicant: IFP ENERGIES NOUVELLES, Rueil-Malmaison (FR)

(72) Inventors: Frederic Augier, Saint Symphorien D Ozon (FR); Arnaud Baudot, Vernaison (FR); Jeremy Gazarian, Condrieu (FR); Damien Leinekugel Le Cocq, Lyons (FR)

(73) Assignee: IFP ENERGIES NOUVELLES, Rueil-Malmaison (FR)

( * ) Notice: Subject to any disclaimer, the term of this patent is extended or adjusted under 35 U.S.C. 154(b) by 510 days.

(21) Appl. No.: 14/360,322

(22) PCT Filed: Oct. 16, 2012

(86) PCT No.: PCT/FR2012/000417

§ 371 (c)(1),
(2) Date: May 23, 2014

(87) PCT Pub. No.: WO2013/076383

PCT Pub. Date: May 30, 2013

(65) Prior Publication Data

US 2014/0319025 A1 Oct. 30, 2014

(30) Foreign Application Priority Data

Nov. 24, 2011 (FR) ..... 11 03593

(51) Int. Cl.
*C10G 19/02* (2006.01)
*C10G 19/08* (2006.01)
(Continued)

(52) U.S. Cl.
CPC ..... *C10G 53/12* (2013.01); *C10G 19/02* (2013.01); *C10G 19/08* (2013.01); *C10G 21/08* (2013.01);
(Continued)

(58) Field of Classification Search
CPC ..... C10G 19/02; C10G 19/08; C10G 21/08; C10G 21/28; C10G 53/06; C10G 53/12
See application file for complete search history.

(56) References Cited

U.S. PATENT DOCUMENTS 2,945,889 A 7/1960 Petty
3,474,027 A 10/1969 Vautrain et al.
(Continued)

FOREIGN PATENT DOCUMENTS

FR 1114509 A 4/1956
GB 728589 A 4/1955

OTHER PUBLICATIONS

International Search Report dated Feb. 12, 2013 issued in corresponding PCT/FR2012/000417 application (pp. 1-3).

*Primary Examiner* — Renee Robinson
(74) *Attorney, Agent, or Firm* — Millen, White, Zelano and Branigan, P.C.

(57) ABSTRACT

Process of extracting sulphur-containing compounds from a hydrocarbon cut of the gasoline or LPG type by liquid-liquid extraction with a soda solution employing a unit (2) for pretreatment of the feedstock to be treated located upstream of the unit (4) for extraction with soda, said pretreatment unit consisting of a first pretreatment reactor operating in batch mode followed by a second continuous reactor of the piston type operating in piston mode.

5 Claims, 4 Drawing Sheets

(51) Int. Cl.

| | |
|---|---|
| ***C10G 21/08*** | (2006.01) |
| ***C10G 21/28*** | (2006.01) |
| ***C10G 53/06*** | (2006.01) |
| ***C10G 53/12*** | (2006.01) |
| ***C10G 21/30*** | (2006.01) |
| ***C10G 21/12*** | (2006.01) |

(52) U.S. Cl.
CPC ..... *C10G 21/12* (2013.01); *C10G 21/28* (2013.01); *C10G 21/30* (2013.01); *C10G 53/06* (2013.01)

(56) References Cited

U.S. PATENT DOCUMENTS

| | | | | |
|---|---|---|---|---|
| 4,207,174 | A | 6/1980 | Christman | |
| 6,749,741 | B1 | 6/2004 | Laricchia et al. | |
| 2012/0103872 | A1* | 5/2012 | Li ..... | C10G 17/07 208/190 |

* cited by examiner

EXTRACTION OF SULPHUR-CONTAINING COMPOUNDS IN A FIRST PRETREATMENT REACTOR OPERATING IN BATCH MODE FOLLOWED BY A SECOND PRETREATMENT REACTOR OF THE PISTON TYPE

FIELD OF THE INVENTION

The invention relates to the field of extraction of sulphur-containing compounds such as mercaptans, COS and $H_2S$ from a hydrocarbon cut. This selective extraction is carried out by bringing the hydrocarbon feedstock in contact in the liquid phase with a soda solution.

PRIOR ART

Extraction of sulphur-containing compounds from a hydrocarbon cut (gasoline, LPG, etc.) by liquid-liquid extraction with a soda solution is well known in the prior art. When most of the sulphur-containing species are mercaptans, or thiols, a type of process that is used very widely consists of performing extraction of the sulphur-containing species by means of a soda solution circulating in a loop in the process, as described in U.S. Pat. No. 4,081,354. The sulphur-containing species of the mercaptan type dissociate into sodium thiolates in the soda. After extraction, the soda laden with sodium thiolates is oxidized in the air in the presence of a dissolved catalyst, for example based on cobalt phthalocyanine. In this way, the species of the sodium thiolate type are converted to disulphides. The soda solution rich in disulphide is brought into contact with a hydrocarbon phase, which makes it possible to extract the disulphides and thus regenerate the soda, which can be recycled to the top of the liquid-liquid extraction column. The parameters associated with oxidation are selected so as to oxidize almost all of the sodium thiolates present in the soda. The process therefore permits partial or complete desulphurization of a hydrocarbon cut, and generates another organic effluent that is heavily laden with sulphur-containing species.

A problem inherent in this type of process is the fact that certain chemical species such as COS or $H_2S$ form salts irreversibly in the presence of soda, and these salts accumulate in the soda loop. An excessive quantity of salts in the soda loop eventually limits its performance. For this reason, regular purges and supplements are carried out on the loop. Another practice that is very widely used consists of pretreating the hydrocarbon upstream of the extraction column, in a vessel containing a soda solution. The effect of this pretreatment is to consume a proportion of the sulphur-containing species, notably the species that form salts. The soda solution used in the pretreatment is not regenerated. This pretreatment stage can be performed in a separate vessel, or in the same vessel as the extraction column, if the latter is partitioned into 2 separate vessels, as described in U.S. Pat. No. 6,749,741.

Thus, extraction of the sulphur-containing species is generally performed in two stages:

- the pretreatment stage: extraction of COS and of residual $H_2S$;
- the stage of continuous extraction in countercurrent of the mercaptans: a stage that is located downstream of the pretreatment stage.

The pretreatment is generally operated in batch mode, and consists of injecting the feedstock into a vessel filled with soda solution, which is changed periodically. Owing to the batch operating mode of the pretreatment, the soda concentration decreases over time, as does its extraction performance. When the performance in pretreatment is too low, the aqueous phase containing the soda is renewed, which can be carried out for example between 1 and 10 times per month depending on the process and the size of the vessel used for pretreatment. The initial soda concentration is generally fixed at a content between 2% and 10% by weight.

The hydrocarbon phase leaving the pretreatment can be extracted with soda in countercurrent in various types of extraction columns. A great many technologies are known, for example those described in the Handbook of Solvent Extraction (Krieger Publishing Company, 1991). These columns are generally designed for generating at least 2 theoretical stages of extraction. An extraction column technology often encountered is that with perforated trays with downcomers, as extraction in countercurrent with soda is often carried out with a soda flow rate much lower than the hydrocarbon flow rate. The ratio between the volume flow rates of hydrocarbon and of soda can vary between 5 and 40. The soda content in the loop is generally fixed at a content between 15 and 25% by weight.

The batch mode of operation of the pretreatment offers the advantage of maximizing its performance relative to continuous operation in a reactor of the perfectly stirred type. Accordingly, the contents of COS and $H_2S$ are on average decreased considerably by the pretreatment stage. In contrast, the sulphur-containing species leaving the pretreatment, including the main species of the mercaptan type, have concentrations that fluctuate depending on the age of the soda solution used in the pretreatment vessel. The fluctuations of total sulphur can thus for example vary from single to double at the inlet of the countercurrent extraction column.

The fluctuations in concentrations cause several problems, as the stages of extraction of the mercaptans, oxidation of the sodium thiolates and regeneration of the soda are operated continuously. Thus, several problems can arise:

1) When the soda used for the pretreatment is at the end of its life, the quantity of mercaptans leaving the pretreatment can be as high as in the pretreatment inlet, or even higher owing to salting out of mercaptans associated with prior accumulation of a large quantity of sodium thiolates and with the excessively low concentration of soda. Thus, surges of high total sulphur concentrations may be present in the inlet of countercurrent extraction, which can potentially generate losses of efficiency of liquid-liquid extraction in the column if the flow rate of soda in the loop is not sufficient for treating the highest concentrations. Moreover, the surges of mercaptans in the hydrocarbon then generate surges of sodium thiolates in the soda at the bottom of the extraction column. The excessively high concentration of sodium thiolates in the oxidizer can lead to partial conversion to disulphide and therefore a return of sodium thiolates in quantity into the regenerated soda, at the top of the extraction column. This can also reduce the performance of the extraction column.

2) Conversely, at the start of the pretreatment cycle, the hydrocarbon entering the countercurrent extraction column contains little sulphur, and therefore the concentration of sodium thiolates in the soda at the bottom of the extraction column is low. In the oxidizer, the quantity of air is then in excess. The oxygen dissolved in the soda is not consumed by the residual sodium thiolates, and is returned directly to the extraction column with the regenerated soda. The oxygen present in the regenerated soda can then react with the mercaptans and produce disulphides within the extractor. These disulphides are then extracted by the hydrocarbon phase to be treated directly in the extraction column, and the result is that the overall performance of the process is reduced.

Thus, fluctuations in the concentration of sulphur-containing species in the hydrocarbon cut to be treated can potentially generate a drop in process efficiency, which is reflected in an increase in the concentrations of sulphur-containing species in the hydrocarbon phase leaving the countercurrent extraction column.

The soda regenerated is reinjected into the extraction column via (6).

Figure 1:
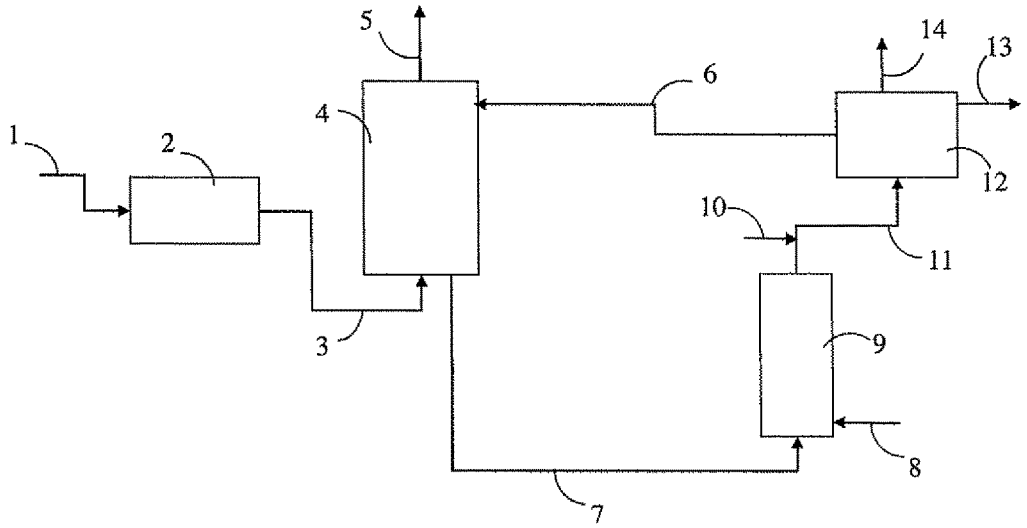
Fig. 1 PRIOR ART
FIG. 1 shows a version of the device according to the prior art. The pretreatment is carried out in a single vessel (2). The extraction column (4) is fed with the feedstock leaving the pretreatment (3) and with regenerated soda (6). The loop for soda regeneration consists of an oxidizer (9) and a three-phase settling tank (12) for separating the air injected at (8) and withdrawn at (14), from an organic phase injected at (10) and withdrawn at (13), the purpose of which is to extract the disulphides formed in the oxidizer.
Figure 2:
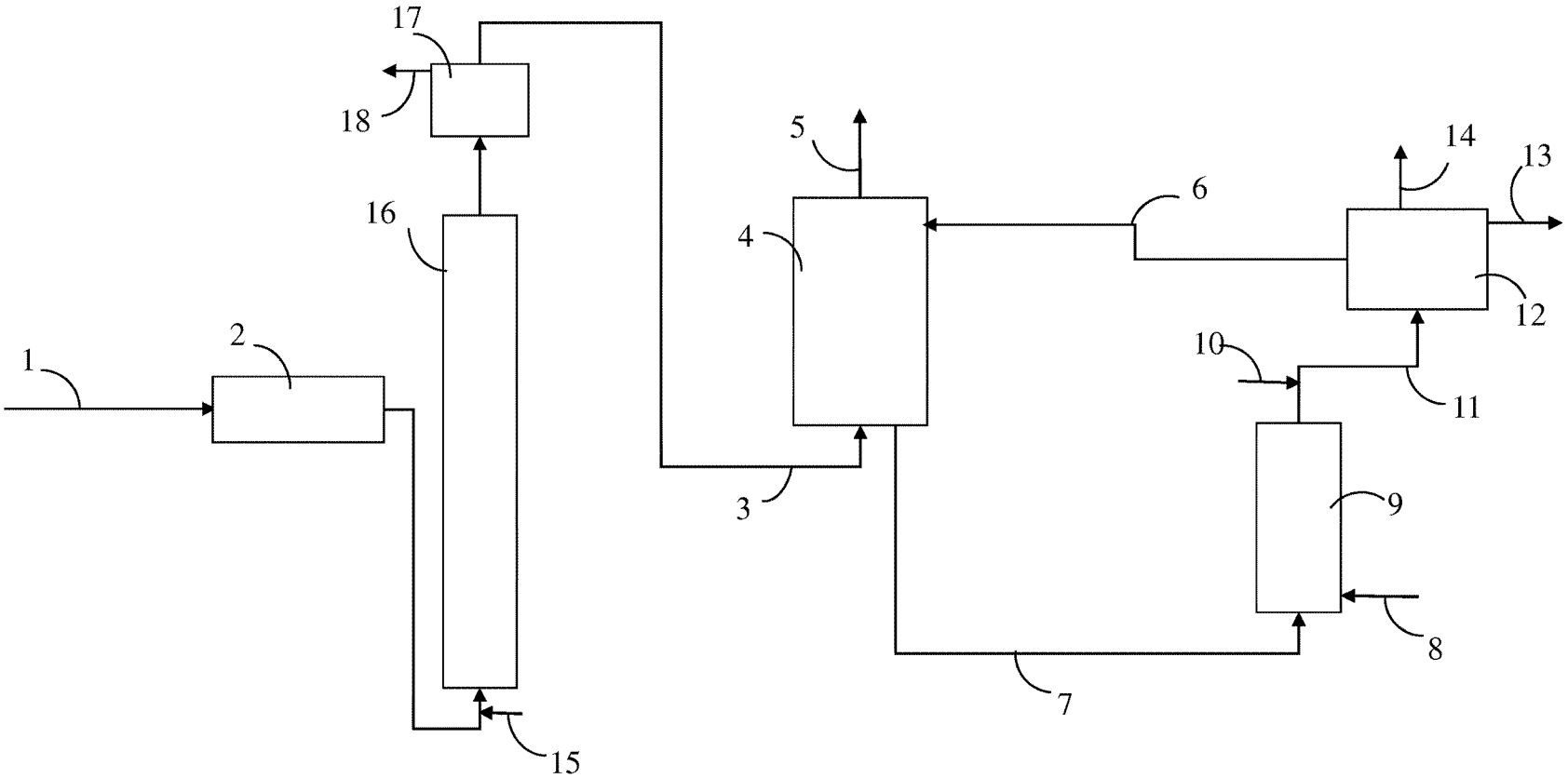

FIG. 2 shows a version of the invention for which the pretreatment is performed in two stages: a first stage in batch mode (2) and a second stage in a continuous co-current reactor of the piston type (16). Fresh soda is fed into the reactor (16) at point (15). The mixture of soda and hydrocarbon phase is separated in the settling tank (17), then the hydrocarbon phase is injected at the bottom of the extraction column (4). The loop for soda regeneration is identical to that in FIG. 1.

A proportion of the pretreatment soda is extracted via line (18).

Figure 3:
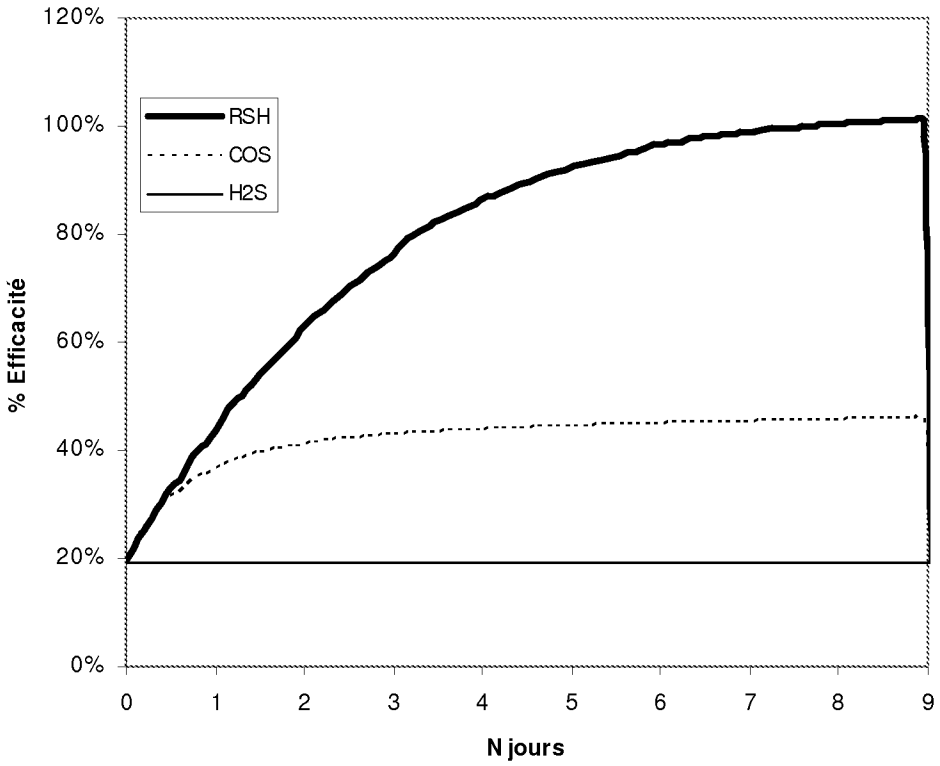

FIG. 3 shows an example of the change in the content of sulphur in the form of mercaptan (thick line), sulphur in the form of COS (dotted line) and in the form of $H_2S$ (thin line) in the hydrocarbon phase leaving the extraction column for the entire duration of the use of the pretreatment soda in a process according to the prior art with a single reactor for pretreatment with soda in batch mode.

Figure 4:
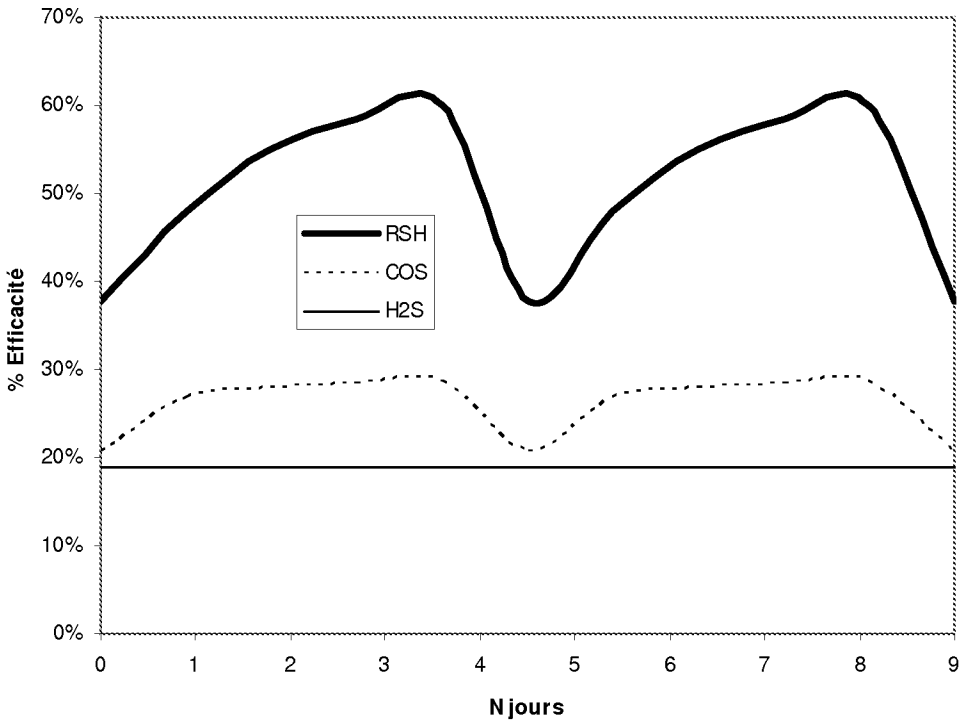

FIG. 4 shows an example of the change in the content of sulphur in the form of mercaptan (thick line), sulphur in the form of COS (dotted line) and in the form of $H_2S$ (thin line) in the hydrocarbon phase leaving the extraction column for the entire duration of use of the soda in the batch stage of the pretreatment system of the process according to the invention.

SUMMARY OF THE INVENTION

The process according to the invention aims to correct partially the problems of performance of the extraction process associated with fluctuations in the contents of sulphur-containing compounds in the effluent from the pretreatment stage. The aim of the invention is to perform a pretreatment that generates less fluctuation in sulphur-containing compounds than in the pretreatment described according to the prior art, while improving its operation.

According to the invention, the pretreatment of the hydrocarbon feedstock is performed in 2 stages:

- a stage performed in batch mode, with a volume of about half that of the pretreatment stage according to the prior art,
- and a second stage performed continuously.

The second pretreatment stage, called the continuous stage here, comprises a reactor supplied in co-current, ascending or descending, between the hydrocarbon phase to be refined and a soda phase. The two phases are in contact in the reactor, making it possible to carry out the extraction of the various acidic chemical species present in the hydrocarbon.

The soda used here can be a fresh soda solution, between 5% and 21%, but can also be a spent soda solution recovered from the main loop of the extraction process, for example during the purges that are carried out for replenishing the composition of the soda.

Owing to an unexpected effect, it was found that the solution with a pretreatment comprising a first batch reactor followed by a second continuous reactor operating in piston flow gives better performance than a single batch reactor of equivalent total size and consuming the same quantity of soda, according to the prior art.

The invention also provides better performance than a continuous reactor of identical total size, even at identical levels of soda consumption.

According to a preferred embodiment of the invention, the continuous stage is carried out in a reactor of the piston type. The piston character of the reactor means that the phases are transported in a preferential direction, the compositions of the two phases gradually change from reactor inlet to reactor outlet, and there is no axial mixing between the various reactive species.

A person skilled in the art is familiar with the work "Génie de la réaction chimique" [Engineering of chemical reactions], Publ. Tec&doc, which explains the piston reactor concept. The piston character of the reactor is associated classically with a Peclet number, defined as follows:

$$Pe = \frac{UL}{D_{ax}}$$

where U is the average velocity of passage of the hydrocarbon through the reactor, L is the length of the reactor, $D_{ax}$ is the coefficient of axial dispersion of the hydrocarbon in the reactor. The usual range of the Peclet number is $1<Pe<50$.

Preferably, the Peclet range in the context of the present invention is $3<Pe<10$, and even more preferably $3<Pe<5$.

The linear velocity U is defined as the ratio of the volume flow rate of the hydrocarbon phase over the reactor section.

The coefficient of axial dispersion of the hydrocarbon phase $D_{ax}$ is determined by measurement with tracing, for example of the colorimetric type, which consists of introducing a coloured portion at reactor inlet and monitoring its change at reactor outlet. The signal at outlet, more or less spread out, is correlated with the coefficient of axial dispersion by processes that are well known to a person skilled in the art.

Preferably, the piston reactor will be filled with a packing of the static mixer type. Several industrial suppliers offer geometries of static mixers. There may be mentioned in particular, but not exclusively, the forms of static contactors of the SMX® type sold by Sulzer Chemtech or the KMX® model marketed by the company Kenics (P. A. Schweitzer, Handbook of separation techniques for chemical engineers, 3rd Ed., McGraw-Hill, NY, 1997; Theron, F.; Le Sauze, N.; Ricard, A., Turbulent liquid-liquid dispersion in Sulzer SMX mixer, Industrial and Engineering Chemistry Research 49 (2010) 623-632; Mahuranthakam, C. M. R.; Pan, Q.; Rempel, G. L., Residence time distribution and liquid holdup in Kenics® KMX static mixer with hydrogenated nitrile butadiene rubber solution and hydrogen gas system, Chemical Engineering Science 64 (2009) 3320-3328).

Preferably, contacting of the hydrocarbon phase with the soda in continuous co-current flow can also be provided by means of a membrane contactor (Gabelman, A.; Hwang, S. T., Hollow fiber membrane contactors, Journal of Membrane Science 169 (1999) 61-106). A membrane geometry of the hollow fibre type in the membrane contactor is particularly suitable as it is a very compact design and offers independent control of the circulation of the two phases in contact independently.

According to a preferred variant of the process according to the present invention, the soda used in the second continuous pretreatment reactor (16) is obtained from the loop for soda regeneration from the extractor.

According to another variant that is even more preferred, the soda used in the second continuous pretreatment reactor (16) is taken between the soda outlet of the extractor (4) and the oxidizer (9).

DETAILED DESCRIPTION OF THE INVENTION

The present invention relates to a process of extracting sulphur-containing compounds present in a hydrocarbon, in the case when the main sulphur-containing species are mercaptans, denoted RSH, for example methanethiol $CH_3SH$, ethanethiol $C_2H_5SH$, propanethiol $C_3H_7SH$, and/or other sulphur-containing species are also present, such as hydrogen sulphide $H_2S$ or carbonyl sulphide COS.

FIG. 1 illustrates a process used for extracting sulphur-containing species according to the prior art. The hydrocarbon cut 1 enters a pretreatment vessel 2 previously filled with a soda solution diluted to a concentration between 2 and 10% by weight. The treated hydrocarbon feedstock leaves the pretreatment via pipeline 3. The soda solution in vessel (2) is renewed according to an operating cycle of between 3 and 30 days, and depending on the age of the soda, the pretreatment extracts a variable quantity of sulphur-containing species, including mercaptans. The hydrocarbon then enters a countercurrent extraction column (4), at the bottom of the column.

The extraction column (4) is also fed with a regenerated soda solution (6), at the top of the column. The soda concentration is then between 15 and 25%. The function of column (4) is to extract most of the mercaptans still present in the hydrocarbon. The hydrocarbon, thus refined, leaves column (4) via pipeline (5). The soda leaving column (4) via pipeline (7), called spent soda, is laden with species of the sodium thiolate type RS—Na, corresponding to the mercaptans extracted, dissociated and recombined with sodium ions $Na^+$.

The flow (7) enters an oxidation reactor, also supplied with air via pipeline (8). The presence of air and of a catalyst dissolved in the soda solution promotes the reaction of oxidation of sodium thiolates to disulphides denoted RSSR. The catalyst used can be of the cobalt phthalocyanine family. The multiphase medium leaving the reactor via pipeline (11) is sent to a separating vessel (12).

A flow (10) of a gasoline cut or of some other hydrocarbon is injected into the soda solution upstream of vessel (12), for example in pipeline (11). It can also be injected into pipeline (7). This flow makes it possible to extract the disulphides and recover, by decanting in vessel (12), a hydrocarbon cut highly enriched in sulphur-containing species (13).

The depleted air leaves the settling tank (12) via pipeline (14). The soda thus regenerated is returned to the top of the extraction column (4) via pipeline (6).

Sometimes a separating vessel is included in line (6) in order to optimize extraction of the disulphides with the hydrocarbon cut. In this case, the hydrocarbon cut (10) used for extracting the disulphides is injected into line (6), and it is then decanted in the additional separating vessel. The hydrocarbon cut then leaving the additional vessel is sent into line (7).

FIG. 2 illustrates a version of the process according to the invention. A second pretreatment stage has been added to the process flowsheet. This second stage consists of a continuous reactor (16) fed with the hydrocarbon leaving the first stage of pretreatment in batch mode (2). The reactor (16) is also fed with a soda phase (15) injected into the pipeline conveying the hydrocarbon between the two stages, or injected directly into the reactor.

The soda injected is at a concentration between 6 and 21% by weight in water. Preferably the soda introduced has a soda concentration between 6% and 15% and even more preferably in the range between 6% and 10%.

Preferably, the volume of the second piston reactor is between 0.1 and 3 times, and more preferably between 0.5 and 1.5 times the volume of the first batch reactor.

The soda flow rate is low relative to the hydrocarbon flow rate, the ratio of volume flow rate between the hydrocarbon feedstock and the soda is between 10 and 100000, and preferably between 500 and 3000.

The two phases, soda and hydrocarbon, circulate in co-current in the reactor.

The piston character can be provided in the reactor in various ways, for example by dividing the reactor volume into separate compartments, separated by baffles.

The two-phase mixture leaving reactor (16) is sent to a decanter (17) for separating the soda phase (18) from the hydrocarbon phase (3), the latter being conveyed to the countercurrent extraction column (4). The soda (18) can be reintroduced at a point of the second piston reactor situated at about mid-length of said reactor.

A variant of the process consists of recycling a proportion of the soda flow (18) to the inlet of the continuous reactor (16), so as to increase the soda flow rate in said reactor.

The soda used in the second continuous pretreatment reactor (16) can be obtained from the loop for soda regeneration from the extractor, and, preferably at a point (7) located between the soda outlet from extractor (4) and the oxidizer (9).

EXAMPLES

The invention will be better understood on reading the following examples.

Example 1

(According to the Prior Art)

Consider a unit for extraction of the mercaptans present in a hydrocarbon phase of the LPG type, a mixture of alkanes and alkenes with 2, 3 and 4 carbon atoms.

The process is similar in all respects to that described in FIG. 1.

The pretreatment comprises a prewashing vessel of 12 $m^3$ filled to ⅔ with a soda solution at 6% by weight, renewed every 9 days.

The hydrocarbon feedstock to be treated has a flow rate of 30 $m^3$/h, and contains 146 ppm (by weight S) of methyl mercaptans, 10 ppm (by weight S) of COS and 7 ppm (by weight S) of $H_2S$.

The composition of the hydrocarbon at the pretreatment outlet as a function of time is obtained by simulation. The contents of RSH, COS and $H_2S$ are shown in FIG. 3. The content of RSH varies considerably between the beginning and the end of the service life of the soda, in this case over a time of 9 days, which is detrimental to good overall operation of the process.

In contrast, it is observed that about 60% of COS and 20% of $H_2S$ are extracted in the pretreatment, which makes it possible to minimize the consumption of soda in the extractor.

Again by simulation, we find the average sulphur content in the refined LPG leaving the process, which is 2.05 ppm (by weight S).

Example 2

(According to the Prior Art)

This example constitutes the continuous version according to the prior art. It is a matter of replacing the stage of pretreatment in batch mode with a continuous stage, in a co-current reactor.

The volume of the pretreatment reactor is identical to the vessel used in Example 1, i.e. 12 $m^3$.

The quantity of soda, also unchanged, is now introduced into the reactor continuously, with a constant flow rate of injection and withdrawal.

The flow rate of 6% soda injected is $3.7\times10^{-2}$ $m^3$/h. The advantage of this implementation in the pretreatment reactor is evidently operation under steady-state conditions, i.e. stabilizing the concentrations at the pretreatment outlet. In this sense, this solution is relevant, since it allows a significant decrease in average sulphur content in the refined LPG leaving the process. By simulation, we find an average sulphur content in the refined LPG of 1.27 ppm (by weight S).

However, this solution presents a problem in terms of efficiency of pretreatment, as illustrated by the COS content in the hydrocarbon phase at the pretreatment outlet obtained by simulation. In fact, this operating mode proves to be of low efficiency in terms of hydrolysis of the COS compounds, as only 50% by weight of the COS compounds entering are converted in this stage, i.e. appreciably less than when using a batchwise pretreatment (Example 1).

This leads to an increased consumption of soda in the extractor.

This solution with a single pretreatment reactor operating continuously is therefore not an effective replacement for the pretreatment in batch mode.

Example 3

(According to the Invention)

The same process now comprises an additional pretreatment stage, of the type of continuous co-current reactor with piston flow, as described in FIG. 2, located downstream of the reactor for pretreatment in batch mode.

The volume of the batch reactor is 6 $m^3$, and the volume of the continuous reactor is 6 $m^3$, so that the total pretreatment volume is identical to Example 1.

The reactor for batch pretreatment is filled to ⅔ with soda at 6% (by weight), renewed every 4.5 days.

The composition of the feedstock and its flow rate are unchanged relative to Example 1.

The continuous piston reactor is fed with soda at 18% (by weight) at a flow rate of 2 L/h, so that the total quantity of soda in the two pretreatment stages is identical to that of the single pretreatment stage in Example 1.

The composition of the hydrocarbon phase leaving the pretreatment, obtained by simulation, is shown in FIG. 4 as a function of time.

It fluctuates with a reduced amplitude relative to the prior art.

This makes it possible to minimize the soda consumption in the extractor, while achieving very efficient extraction of the RSH compounds in the extractor. In fact, by simulation, we obtain an average sulphur content in the hydrocarbon leaving the process, i.e. measured at the top of the extraction column, of 1.23 ppm (by weight S).

This represents a 40% reduction in the level of sulphur at the outlet relative to the process according to the prior art (Example 1).

The invention claimed is:

1. A process extracting sulphur-containing compounds from a gasoline or LPG hydrocarbon cut comprising liquid-liquid extraction of salts with a soda solution in a pretreatment unit (2) located upstream of an extraction unit (4) employing soda to extract sulfur compounds as sodium thiolate, said pretreatment unit comprising a first pretreatment reactor operating in batch mode followed by a second continuous reactor operating in piston mode with a Peclet number $$Pe = \frac{UL}{D_{ax}}$$

between 3 and 10, U denoting the linear velocity of flow of the hydrocarbon phase in the reactor, L the length of the reactor, and $D_{ax}$ the coefficient of axial dispersion of the hydrocarbon phase in the second continuous reactor.

2. The process according to claim 1, in which the second continuous reactor has a volume of 0.5 and 1.5 times the volume of the first batch reactor.

3. The process according to claim 1, in which effluents leaving the second continuous reactor enter a settling tank (17) recovering a soda flow (18), and reintroducing said soda flow (18) at a point of the second continuous reactor located at about mid-length of said reactor.

4. The process according to claim 1, comprising a soda regeneration loop regenerating soda from the extraction unit, and wherein the soda used in the second continuous pretreatment reactor (16) is obtained from the loop for soda regeneration.

5. The process according to claim 4, in which the soda used in the second continuous pretreatment reactor (16) is obtained from a point (7) located between a soda outlet from the extraction unit (4) and an oxidizer (9) regenerating the soda.

* * * * *